US005335579A

United States Patent [19]

David

[11] Patent Number: 5,335,579

[45] Date of Patent: Aug. 9, 1994

[54] INDEXING HELICAL FEED MAGAZINE

[75] Inventor: James C. David, Bakersfield, Calif.

[73] Assignee: Calico Light Weapon Systems, Bakersfield, Calif.

[21] Appl. No.: 45,093

[22] Filed: Apr. 12, 1993

[51] Int. Cl.[5] ..... F41A 9/03

[52] U.S. Cl. ..... 89/34; 42/49.01; 42/19; 89/33.17

[58] Field of Search ..... 89/34, 33.02, 33.17; 42/19, 49.01

[56] References Cited

U.S. PATENT DOCUMENTS

| | | | |
|---|---|---|---|
| 84,685 | 12/1868 | Evans . | |
| 213,555 | 3/1879 | Evans . | |
| 1,285,263 | 11/1918 | Lohne . | |
| 1,304,274 | 5/1919 | De-Felice | 89/33.02 |
| 1,487,722 | 3/1924 | Coenders | 89/33.17 |
| 1,747,546 | 2/1930 | Janecek | 89/33.02 |
| 2,631,578 | 3/1953 | Laughlin | 124/27 |
| 3,088,378 | 5/1963 | Boudreau . | |
| 3,427,923 | 2/1969 | Meyer et al. . | |
| 3,447,527 | 6/1969 | Cermak et al. | 42/49.01 |
| 4,034,644 | 7/1977 | Hupp et al. | 42/87 |
| 4,166,408 | 9/1979 | Wetzel et al. | 89/34 |
| 4,207,797 | 6/1980 | Györik et al. | 89/34 |
| 4,384,508 | 5/1983 | Sullivan et al. . | |
| 4,676,137 | 6/1987 | Stockton et al. | 89/33.02 |
| 4,738,183 | 4/1988 | Miller et al. | 89/34 |
| 4,766,800 | 8/1988 | Miller et al. | 89/33.02 |
| 4,819,609 | 4/1989 | Tippmann | 124/72 |
| 4,831,914 | 5/1989 | Dardick et al. | 42/49.01 |
| 4,888,898 | 12/1989 | Miller et al. | 42/49.01 |
| 4,945,664 | 8/1990 | Miller | 42/49.01 |
| 4,947,572 | 8/1990 | Miller et al. | 89/33.02 |
| 4,962,604 | 10/1990 | Miller et al. | 42/49.01 |
| 4,965,951 | 10/1990 | Miller et al. | 42/49.01 |
| 5,097,816 | 3/1992 | Miller | 124/49 |
| 5,166,457 | 11/1992 | Lorenzetti | 42/49.01 |
| 5,174,807 | 12/1992 | MacDonald | 71/86 |

FOREIGN PATENT DOCUMENTS

| | | | |
|---|---|---|---|
| 2010554 | 8/1976 | Fed. Rep. of Germany . | |
| 3809319 | 9/1989 | Fed. Rep. of Germany . | |
| 636434 | 5/1983 | Switzerland | 89/33.02 |

*Primary Examiner*—Stephen M. Johnson

*Attorney, Agent, or Firm*—Roylance, Abrams, Berdo & Goodman

[57] ABSTRACT

An improved magazine for fragile projectiles such as pellets or paint balls, wherein the front end of a rotating drive member is formed with elongated fingers to form individual chambers to feed the projectiles one by one out of the magazine synchronously with the firing of the gun. An escapement member operated by some portion of the gun permits rotation of the carrier within the housing of the magazine, one projectile distance at time, to cooperate with the elongated fingers and an exit ramp formed in the front end cap of the magazine. The projectiles do not contact each other radially while in the magazine.

15 Claims, 3 Drawing Sheets

INDEXING HELICAL FEED MAGAZINE

FIELD OF THE INVENTION

This invention relates to an improved magazine for relatively delicate projectiles such as pellets, "paint balls", and the like. More particularly, the invention relates to such a magazine for holding a relatively large number of such projectiles, and for feeding them, individually, out of the magazine and into a cooperating gun, synchronously with the firing of the gun.

BACKGROUND OF THE INVENTION

Conventional cartridges used in firearms are relatively rugged, and many multicartridge magazines feed the cartridges out of the magazine by pressure on a row of cartridges against a stop, which stop is often called feed lips.

The present invention pertains to projectiles other than such cartridges, such as conventional pellets, other pellet-like projectiles, and marking projectiles commonly called paint balls. The guns with which such projectiles are used are usually gas or spring operated.

Conventional pellets are used for target practice, amusement, and the like and other purposes. Paint balls are used by veterinarians and wild life management personnel to mark and otherwise control animals. Another very popular use for paint balls is a sport which has been increasing in popularity in recent years. This sport usually involves groups of participants or players formed into two or more sides, with the sides engaging in a mock combat. Each player is armed with a suitable gun, usually gas operated, and the gun fires the spherical frangible liquid filled projectiles containing a paint or dye called paint balls. The idea is to hit and mark and thus "kill" an opponent, without actually doing any injury to such opponent.

In all of these environments, it is desirable that a magazine be provided to hold a relatively large number of such projectiles, while not damaging the projectiles, and assuring proper feeding of each projectile, from the first to the last, from the magazine into the gun.

In many of these cases, due to the fragility of the projectiles, these guns typically hold only one projectile at a time, and thus require manual reloading after each shot. Many of these guns fail to provide a self-loading feature, even in the case where a magazine to hold a plurality of the projectiles is provided.

Often such magazines depend upon gravity feed of the projectiles. This is highly undesirable, because it requires one specific orientation only of the magazine with respect to the gun and of the gun in use, because the projectiles can easily jam, and because the total capacity of projectiles, especially of paint balls, tends to be relatively small. Other solutions as to paint balls involve a tape or belt in which the paint balls are preloaded. These solutions are undesirable for many obvious reasons including extra cost, added problems in handling the paint balls, the used belts being debris, and the like.

BRIEF DESCRIPTION OF THE INVENTION

The invention provides an improved magazine of the character described which utilizes the well developed technology of other magazines for firearms. In this regard, reference may be had to U.S. Pat. Nos. 4,676,137, 4,965,951, and 4,766,800, among numerous others related to this field which are commonly owned with the present application. That is, the present invention utilizes most of the technology developed for such magazines for use with conventional cartridges, and makes certain additions and modifications to such magazines for use with fragile projectiles such as pellets and paint balls. To the extent it might be needed to complete the teaching of this application, the teachings of all of said prior commonly owned patents are hereby incorporated by reference as if here set forth in full.

SUMMARY AND ADVANTAGES OF THE INVENTION

In common with the magazines of the aforementioned patents, the present invention includes a fluted projectile carrier or drive member which rotates within a housing having a spiral or helical rib on the inside surface thereof. The cooperation of these two elements with the projectiles, coupled with rotation of the carrier, feeds the projectiles through the flutes and to one end of the magazine for delivery to the gun. A major improvement however is the provision of an indexing or escapement member operated by the bolt or some other part of the gun to cause the carrier to rotate a distance proportional to half a projectile diameter with each forward and reverse operation of the bolt or the like. At the feed end of the magazine, the end cap is formed with a feed ramp, which cooperates with elongated fingers at the end of the ribs forming the flutes within which the projectiles are loaded in the carrier or drive member. In this manner, in effect, an individual chamber is formed for each projectile as it is fed out of the magazine and into the gun. This protects the fragile projectiles as they are fed out of the magazine and into the gun because the projectiles do not press hard on each other as they feed into the gun. Also, the projectiles can be fed downwardly, sidewise, or upwardly into the gun. In the guns developed in accordance with the aforementioned prior patents, the magazine is generally arranged axially aligned with and above the axis of the gun and thus the projectiles normally feed downwardly into the gun. However, this is not a limitation on the invention, other feeding arrangements are possible.

Most prior magazines, including most of those commonly owned with the present application, include feed lips at the exit end of the magazine, as mentioned above. These feed lips hold back all remaining cartridges or projectiles in the magazine, but this creates an undesirable heavy pressure on the projectiles which could damage them, in the case of the fragile projectiles with which the present invention is used. Elimination of the feed lips in the magazine of the present invention is another improvement of the present invention.

BRIEF DESCRIPTION OF THE FIGURES OF THE DRAWING

The invention will be better understood with reference to the following description and the accompanying drawing, which drawing also forms a part of this disclosure, and in which.

DETAILED DESCRIPTION OF THE PREFERRED EMBODIMENTS

Figure 1:
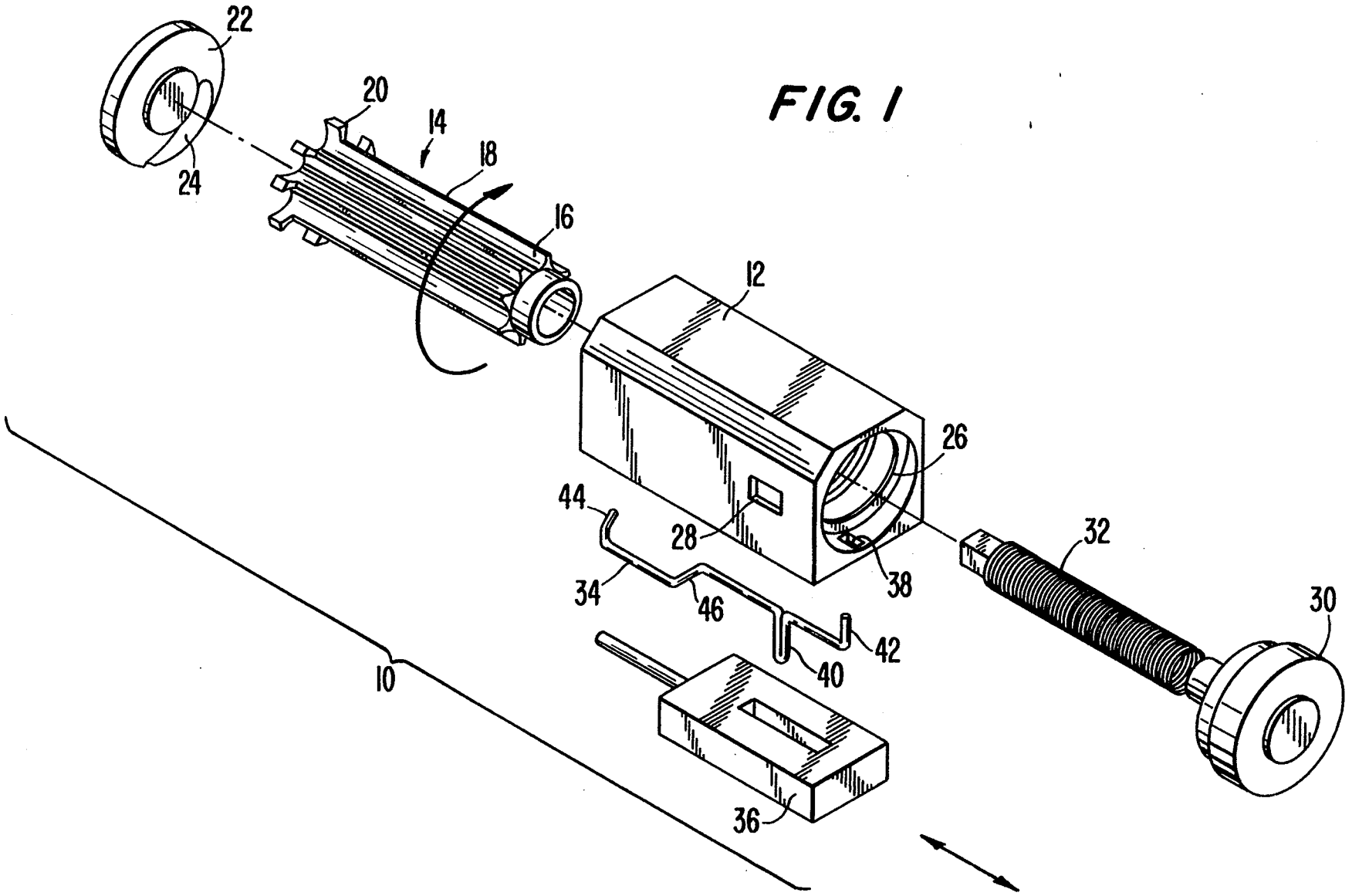
FIG. 1 is an overall exploded perspective view showing the magazine of the invention.

Referring now in more detail to the drawing, in FIG. 1 there is shown a magazine 10 embodying the invention. Magazine 10 comprises a housing 12 and a projectile carrier or drive member 14. The drive member 14 comprises a plurality of flutes 16 which are defined by ribs 18. At the feed end of the magazine, the ribs 18 are formed with elongated fingers 20. The magazine also includes an end cap 22 which is formed with an exit ramp 24.

The housing 12 is formed with an internal spiral rib 26, and an opening 28 for feeding the projectiles into the magazine.

Means are provided to rotate the drive member 14 within the housing 12. To this end, the other end cap of the housing 10 comprises a winding means and clutch 30 which cooperates with a drive spring 32.

Means are provided to cause indexing motion of the carrier 14 within the housing 12. To this end, an escapement member 34 is provided which cooperates with suitable openings in the housing, see opening 38 at one end in FIG. 1, and opening 39 is FIGS. 2 and 4 at the other end.

Escapement member 34 comprises an escapement operating finger 40 for cooperation with the bolt 36, a rear dog 42, a front dog 44, and an offset portion 46. The dogs 42 and 44 cooperate with the ribs 18 and fingers 20, as described below. While the invention is shown being operated by a bolt 36, other types of interactions between the invention magazine and the gun are possible. For example, operation of the invention magazine can be controlled by trigger pulls of the gun, or by a lever or a pump of lever or pump operated guns.

Referring now to FIGS. 2, 2A, 3, 3A, 4 and 4A, the manner of operation as to the indexing of the carrier or drive member with the pellets 48 therein is shown. Use with pellets 48 is shown by way of example. Those skilled in the art can easily make the minor changes needed for use of the invention with paint balls or other projectiles.

In these FIGS. 2 to 4A, numerous parts have been omitted including the end cap 22, the winder 30 and spring 32, and numerous other parts, for the purpose of illustrating the manner of operation of the indexing of the invention. The invention has been shown for use with conventional pellets 48, having pointed noses and rear skirts. Other shapes and types of pellets and fragile projectiles, including the popular paint balls, can also be used. As to pellets, it is an important advantage of the invention that by simply changing the end cap 22 and the exit ramp 24 therein, different configurations of the noses of pellets can be accommodated. That is, while pointed nose pellets are shown, rounded nose, and other shapes can be easily accommodated by this simple modification of the end cap.

Figure 2:
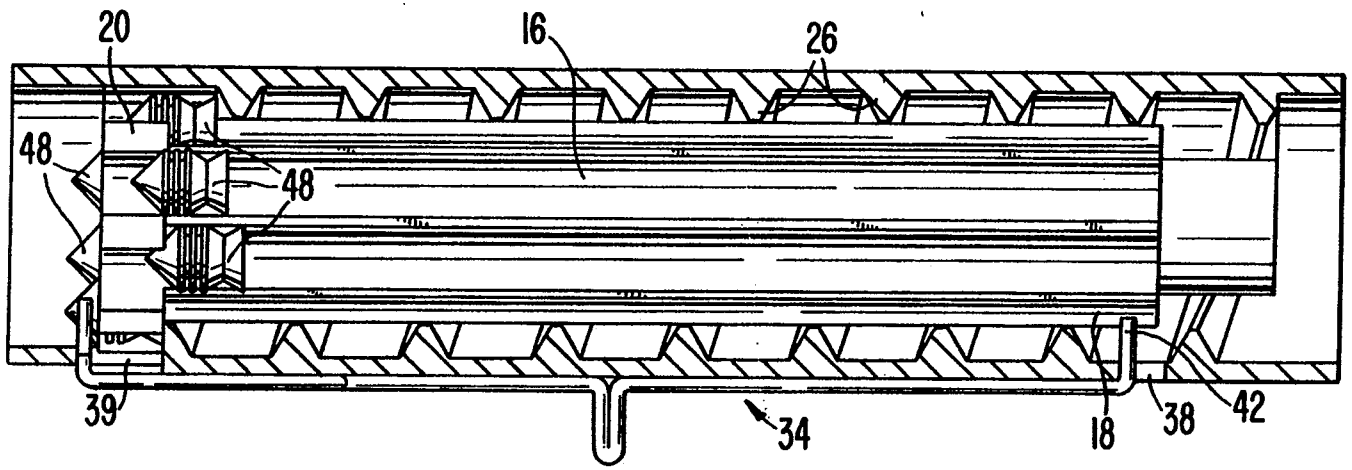
FIGS. 2, 2A, 3, 3A, 4 and 4A are a series of side and end views showing the manner of operation of the indexing or escapement mechanism of the invention.
Figure 3:
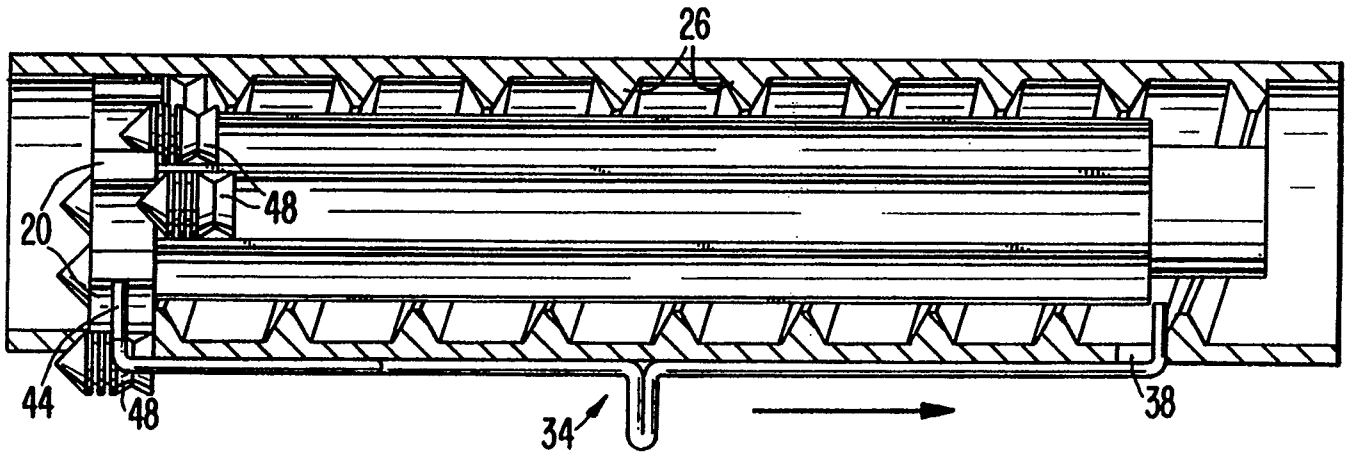
Figure 2A:
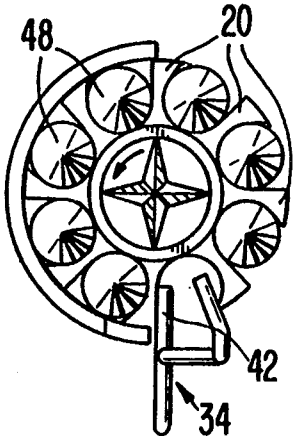
Figure 4:
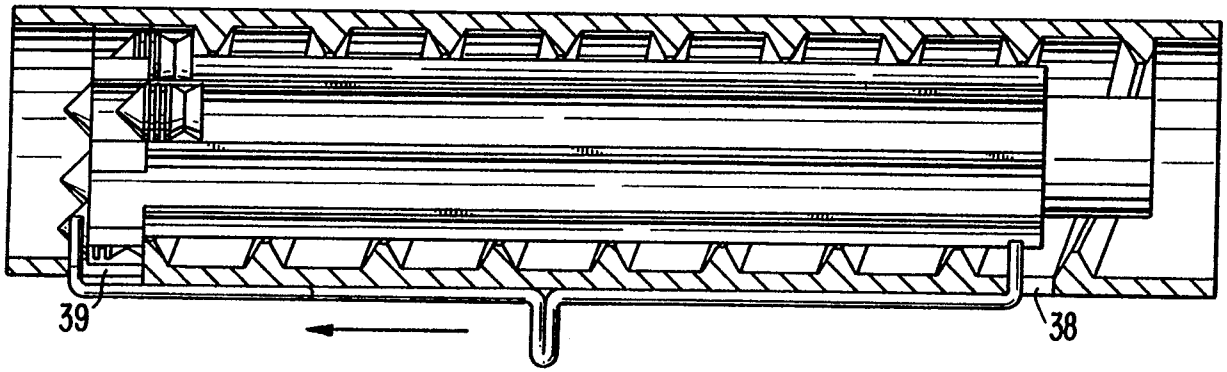

Referring now to the family of FIGS. 2 through 4 and their end views, the manner in which the invention magazine is made to operate synchronously with operation and firing of the gun is shown. In FIGS. 2 and 2A, the escapement 34 is shogun in its forward position wherein the rear dog 42 of the escapement 34 is engaging the ribs 18 of the carrier 14 preventing its rotation. The front dog 44 is clear of the carrier at this time.

Figure 3A:
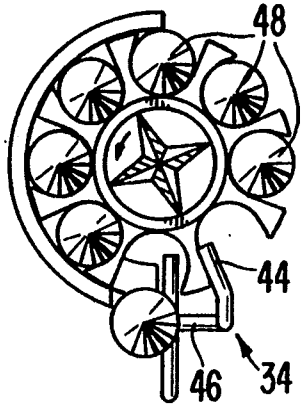

In the next step, FIGS. 3 and 3A, the escapement has been indexed to the rear positioning front dog 44 first to prevent an uncontrolled run away of the spring energy driving the carrier 14. After engagement of the front dog 44, the parts are configured so that the rear dog 42 becomes clear of the carrier 14 as shown. This permits the carrier 14 to rotate a distance proportional to one half the diameter of a projectile. This is controlled by the offset arm 46 of the escapement mechanism. At this time, one pellet 48 is ejected from the magazine into the gun.

Figure 4A:
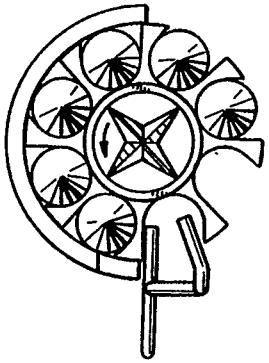

Finally, in FIGS. 4 and 4A, the escapement 34 has been again indexed forward, again blocking the projectile carrier 14 from further rotation by the rear dog 42. This completes one cycle, and it can be seen that the parts in FIG. 4 are in the same relative positions as they are in FIG. 2, with the difference that one pellet has been ejected from the magazine.

Figure 5:
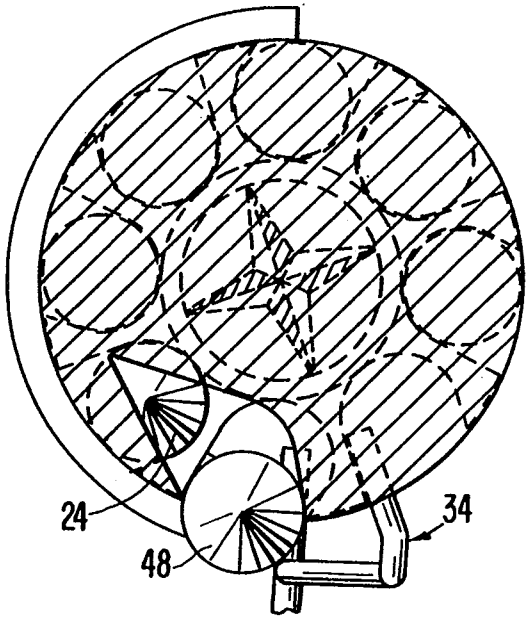
FIG. 5 is a developed end view showing the feeding of a projectile out of the magazine.

In FIG. 5, a developed view, it can be seen that the projectile 48 is gently fed out of the magazine by the feed ramp or exit ramp 24 formed in the end cap of the magazine, see also FIG. 1. It is also to be noted that the elongated fingers 20 are formed so as to fit or mate well with the configuration of the particular projectiles 48 being handled in the magazine.

It should be noted that the projectiles 48 are subjected to virtually no stresses at all while being handled in the magazine of the invention. However, as they progress through the magazine, through the flutes 16, they are subjected to a slight longitudinal pressure caused by the feeding action of the spiral rib 26 formed on the inside of the housing. As each projectile engages the feed ramp 24, this is changed to a slight radial pressure, the longitudinal pressure being reduced to zero. However, these pressures are very gentle, and the projectiles do not contact each other radially while in the carrier 14 and the fingers 20. It has been found that the fragile projectiles with which the invention is used are in no way damaged by feeding through the magazine of the invention.

Figure 6:
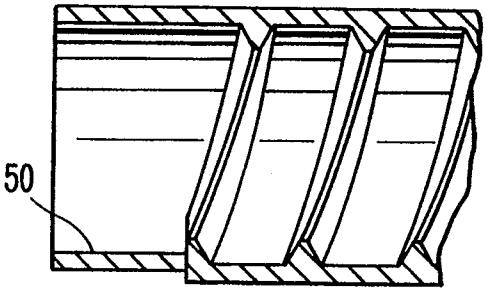
FIG. 6 is a partial longitudinal cross-sectional view showing a detail.

Finally, referring to FIG. 6, a cut away portion 50 at the front end of the magazine is shown. The rib 26 is cut away to allow clearance for the radially extended fingers 20 at the front end of the ribs. While one might expect that the pellets are free to fall out of the magazine as shown in FIGS. 2, 3 and 4, in fact they are held constrained by the inside surface of the end cap which is not formed into the feed ramp 24, see FIG. 1.

Opening 28 is used to load the magazine. More specifically, the winder 30 is first operated to charge the spring 32. A single projectile is then deposited in the port 28. The escapement 34 is then operated manually to the rear and then returned to its forward position. This motion allows the projectile carrier 14 to rotate one projectile diameter positioning it to receive another projectile through the opening 28. This procedure is repeated until the magazine is fully loaded. Then, using the clutch within the device 30, the excess spring energy is released, and a predetermined energy is imparted to the spring 32. The magazine is at that point fully loaded with the spring properly tensioned and ready for use.

Finally, it is anticipated that magazines made according to the invention will be able to hold, as examples, up to 100 68 calibre paint balls, or up to 120 0.177 calibre pellets, or even more, if necessary.

While the invention has been described in some detail above, it is to be understood that this detailed description is by way of example only, and the protection granted is to be limited only by the spirit of the invention and the scope of the following claims.

I claim:

1. A magazine for a cooperating gun for feeding projectiles from said magazine into said gun, said magazine being of a generally elongated configuration, said magazine comprising an outer housing, a drive member for said projectiles rotatably mounted within said outer housing, said drive member being formed with a plurality of ribs extending axially inwardly, said ribs defining flutes between adjacent said ribs, each of said flutes being so configured as to permit a succession of said projectiles to pass therethrough in end-to-end relationship, a drive spring strong enough to rotate said drive member within said housing even with all of said flutes filled with said projectiles, said housing comprising a helical thread portion on the inside surface thereof cooperable with the projectiles in said flutes of said drive member; feed means at an exit end of said magazine to permit the projectiles therein to be fed one by one out of said magazine and into said gun; manual spring winder means for said drive spring mounted on said magazine, said magazine also comprising an exit end cap and an escapement member, wherein said escapement member, said drive member, said outer housing and said drive spring cooperate with a portion of said gun to cause indexing operation of said magazine synchronously with the operation of said gun.

2. The magazine of claim 1, said projectiles having a longitudinal axis and a circular cross section along a portion of the longitudinal axis, said escapement member including front and rear end dogs extending through suitable openings formed in said magazine outer housing, and said front and rear dogs being offset from each other radially of said outer housing by an amount proportional to half the diameter of one of said projectiles.

3. The magazine of claim 2, said magazine having an exit end cap on said exit end, said drive member ribs having rear ends and being radially elongated to form elongated fingers at the exit end, and said exit end cap being formed with an exit ramp cooperating with said projectiles an said elongated fingers, said escapement member front dog having a shape for cooperation with said elongated fingers, and said escapement member rear dog having a shape for cooperation with the rear ends of said drive member ribs.

4. The magazine of claim 1, said magazine having said exit end cap on said exit end, said drive member ribs being formed into radially elongated fingers at the exit end thereof, and said exit end cap being formed with an exit ramp cooperating with said projectiles and said elongated fingers.

5. The magazine of claim 4, said helical thread portion on the inside of said housing being cut away at one end thereof for acceptance of said exit end cap and for cooperation with said elongated fingers.

6. The magazine of claim 1, wherein said projectiles comprise pellets.

7. The magazine of claim 1, wherein said projectiles comprise paint balls.

8. The magazine of claim 1, said housing having a rear end, said housing being formed with an opening at the rear end thereof to permit loading of said projectiles into said magazine by manipulation of said escapement member and rotation of said drive member by said drive spring.

9. The magazine of claim 1, said winder means including manual drive spring release means for relieving the energy stored in said drive spring regardless of the number, from zero to maximum, of said projectiles stored in said magazine, and means for operating said winder means and said manual release means independently of the loading and unloading of said projectiles into and out of said magazine.

10. A magazine for storing and feeding projectiles from said magazine into a cooperating gun, comprising:

an outer housing, said outer housing comprising a helical thread portion on the inside surface thereof;

a drive member for said projectiles rotatably mounted within said outer housing, said drive member being formed with a plurality of ribs extending axially inwardly, said ribs defining flutes between adjacent said ribs, each of said flutes being so configured as to permit a succession of said projectiles to pass therethrough in end-to-end relationship;

wherein said helical thread in said housing is cooperable with the projectiles in said flutes of said drive member;

a drive spring strong enough to rotate said drive member within said housing even with all of said flutes filled with said projectiles; and escapement means including means which interact with said gun such that operation of said gun activates said escapement means to feed said projectiles individually out of said magazine and into said gun synchronously with the operation of said gun.

11. A magazine according to claim 10, wherein said magazine is of a generally elongated configuration.

12. A magazine according to claim 11, wherein said escapement means including means to cause said projectiles to be individually fed out of said magazine and into said cooperating gun with no pressure between said projectiles which could damage said projectiles during said feeding.

13. A magazine according to claim 12, wherein said magazine has an exit end, said projectiles passing through said exit end to said gun when said projectiles are fed from said magazine to said gun;

said drive member ribs having radially elongated fingers at the exit end;

said magazine further comprises an exit end cap having an exit ramp which cooperates with said elongated fingers to direct said projectiles from said magazine into said gun.

14. A magazine according to claim 13, wherein said magazine has a first end opposite said exit end, said first end having an opening to permit loading of said projectiles into said magazine by manipulation of said escapement means.

15. In a magazine for feeding projectiles from said magazine into a cooperating gun, the improvement comprising escapement means forming a part of said magazine, said escapement means comprising:

means for interacting with said gun to operate said escapement means and said magazine to feed said projectiles individually out of said magazine and into said gun synchronously with the operation and firing of said gun, and an escapement member, said magazine including a drive member in which said projectiles are loaded, said escapement member including portions cooperable with said drive member to cause said drive member to move in a manner proportional to the size of said projectiles to cause said individual feeding of said projectiles out of said magazine and into said gun;

wherein said means for interacting includes front and rear end dogs formed on said escapement member and cooperating with said drive member, and said front and rear dogs being offset from each other radially of said magazine by an amount proportional to half the diameter of one of said projectiles.

* * * * *